US005446242A

United States Patent [19]

Barrett

[11] Patent Number: 5,446,242

[45] Date of Patent: Aug. 29, 1995

[54] INSULATOR

[75] Inventor: Donald C. Barrett, Wiltshire, England

[73] Assignee: Raychem Limited, London, England

[21] Appl. No.: 142,352

[22] PCT Filed: May 22, 1992

[86] PCT No.: PCT/GB92/00938

§ 371 Date: Nov. 23, 1993

§ 102(e) Date: Nov. 23, 1993

[87] PCT Pub. No.: WO92/21130

PCT Pub. Date: Nov. 26, 1992

[30] Foreign Application Priority Data

May 24, 1991 [GB] United Kingdom ..... 9111299

[51] Int. Cl.[6] ..... H01B 17/42

[52] U.S. Cl. ..... 174/140 R; 174/137 R; 174/211

[58] Field of Search ..... 174/211, 137 R, 139, 174/140 R, 141 R, 209, 210, 212, 178, 179, 195; 361/132; 285/42

[56] References Cited

U.S. PATENT DOCUMENTS

| | | | |
|---|---|---|---|
| 3,192,312 | 6/1965 | Sauer | 174/209 |
| 4,053,707 | 10/1977 | Ely et al. | 174/209 |

FOREIGN PATENT DOCUMENTS

| | | | |
|---|---|---|---|
| 0328365A2 | 8/1989 | European Pat. Off. | H01B 17/42 |
| 0328365A3 | 8/1989 | European Pat. Off. | H01B 17/42 |
| 283009A5 | 9/1990 | German Dem. Rep. | H01B 17/42 |
| 679220 | 8/1939 | Germany | 174/209 |
| 252351 | 2/1967 | Germany | H01B 17/02 |
| 1542845 | 3/1979 | United Kingdom | H01B 17/42 |

*Primary Examiner*—Leo P. Picard
*Assistant Examiner*—Paramita Ghosh
*Attorney, Agent, or Firm*—Herbert G. Burkard; Yuan Chao; A. Stephen Zavell

[57] ABSTRACT

A generally-planar polymeric protective shield (2) for mounting on a high voltage porcelain insulator (16) has circumferential and radial intersecting grooves (8,10) in its upper surface. The intersections are deepened to provide point projections (12) from the lower surface thereby to space the major portion of the shield (2) from the insulator (16). The convoluted upper surface of the shield (2) enhances the physical protection of the porcelain of the insulator (16).

12 Claims, 2 Drawing Sheets

INSULATOR

This invention relates to high voltage electrical insulators, and particular to porcelain shedded insulators. By high voltage is meant a voltage in excess of about 1 kV, and particularly but not exclusively voltages in excess of about 8 kV.

Such insulators are elongate and comprise a generally cylindrical core and a plurality of sheds integral therewith and extending radially therefrom so as to enhance the creepage path length end-to-end between the conductive terminals of the insulator and to deflect, or shed, water and other liquid contaminants therefrom.

It is known to mount additional insulating components on the insulator for various purposes. EP-A-0 328 365 (Raychem Limited) for example discloses the mounting of a wraparound polymeric component on the porcelain sheds so as to extend beyond the periphery thereof in order to extend the creepage path length. This additional component is of incomplete annular configuration and may or may not employ a closure member. In order to function as a creepage extender however the component must be bonded to the surface of the porcelain shed. A polymeric wraparound device is described in UK Patent No. 1542 845 that enhances the performance of a porcelain insulator, but in a totally different manner and for a totally different purpose from that of the creepage extender. This device, known as a booster shed and available from Raychem, is wrapped around an insulator in the region of one of its porcelain sheds and overlaps itself at its free ends which are then interengaged by a pop-stud fastening arrangement. It is a specific feature of the functioning of the booster shed that in order to improve the performance of the insulator under heavy wetting conditions, it be spaced away from the surface of the porcelain shed. The booster shed reduces the damaging effect that any electrical discharges that occur on the surface of the porcelain may have. In order to achieve this increased performance it is not necessary to mount a booster shed on each of the porcelain sheds of the insulator. It is also known merely to provide mechanical protection of the vulnerable porcelain material of insulators by mounting additional components of polymeric material on the sheds thereof. For example missiles such as stones, bricks or air rifle pellets can shatter porcelain on impact therewith. For this reason, it is advantageous to enclose the porcelain, or at least the laterally extending sheds thereof, within polymeric material for protection, and so-called vandal shields are available for this purpose. In general configuration, such protective shields can be for example as disclosed in GB-B-1542 845, but for this application they are preferably mounted on all the porcelain sheds for maximum benefit.

It is one object of the present invention to provide an insulating member for mounting on a porcelain insulator having improved properties, in particular providing improved mechanical protection.

In accordance with the present invention, there is provided an electrically insulating and substantially non-tracking generally planar member suitable for mounting on a shedded elongate porcelain high-voltage insulator, the member being of annular configuration and being arranged for mounting around and spaced apart from a core of the insulator and for mounting over and spaced apart from a shed of the insulator, wherein an upper surface of the member has channels formed therein that project from a lower surface of the member, the channels intersecting to provide a plurality of projections from the lower surface thereof.

Advantageously the channels are provided by at least one channel, and preferably at least two channels, extending generally circumferentially of the annular member and at least one channel, and preferably at least two channels, extending generally radially thereof.

Preferably the intersections of the channels are deeper than the other portions of the channels, such that the projections extend substantially in only one dimension.

Although the channels of the planar member are preferably formed as a first set of a plurality of channels extending circumferentially around the annular member and a second set of a plurality of channels extending radially thereof, it is envisaged that other patterns of intersecting channels may be employed. For example, the channels could form a diamond-shaped pattern in the surface, or could comprise two sets of opposite-handed spiral patterns. Preferably the intersection areas of the channels are deeper than the channels themselves in order to provide in use discrete substantially point contacts with the underlying supporting porcelain insulator. It is however also envisaged that the depth of the channels at the intersection areas is the same as elsewhere along the channels, thereby providing projections that make contact with the porcelain along series of ridges. The latter configuration may however tend to trap moisture and other contaminants.

Known additional components for insulators have surfaces that, apart from any projections spacing them from the porcelain, are substantially flat. The impact of a heavy object such a brick on a flat surface can cause that surface to be depressed such that the force of the impact is transferred by contact directly on to the porcelain. The generally planar member of the present invention, however, due to the channels in its upper surface, presents a surface that is undulating in two directions, which may be perpendicular to one another. This configuration enhances the ability of the generally planar member to absorb shocks without transferring them directly to the underlying supporting porcelain structure.

Advantageously, the planar member is of wraparound configuration and has means for closing it around the insulator with or without a gap being present between opposing substantially radial edges of the planar member. The closure means may comprise at least one projection extending from one of the edges that is arranged to engage a corresponding aperture in the other edge. Preferably two or more such interengaging projections and apertures are provided. A wraparound device allows the planar member to be fitted conveniently on to the insulator, especially, but not only, as a retrofit on to an insulator that is in service and that has electrical connections already made to its upper and lower terminals, which connections do not then need to be removed.

The annular planar member is advantageously spaced also from the central core of the insulator by one or more inwardly-directed projections. Thus, the planar member is spaced over its major surface area from both the porcelain core and porcelain shed of the insulator.

Preferably the planar member is made from a polymeric material that not only is electrically insulating but also is substantially non-tracking, that is to say it is resistant to the formation of carbonaceous paths there-along due, for example, to the passage of leakage currents over its surface. Advantageously, the planar member is formed by a comparatively inexpensive vacuum forming technique.

It is to be understood that the term 'insulator' used herein includes not only components that in use function only as electrical insulators, but also components that have insulating properties, and that perhaps act as insulators for only a part of their operable lifetime. Thus, 'insulator' is to be understood as including components such as surge arrestors, bushings and feed-throughs, all having mechanically vulnerable porcelain sheds that are protectable by the planar member of the present invention.

In accordance with another aspect of the present invention, there is provided a porcelain insulator that comprises an elongate core and at least one shed extending radially therefrom, wherein a planar member as hereinbefore described is mounted on the shed.

When the insulator comprises a plurality (i.e. two or more) of the sheds, preferably a planar member is mounted on each shed. It is envisaged, however, that planar members may be mounted on a fewer number of the sheds of the insulator.

An electrically insulating and substantially non-tracking generally planar member, and an insulator comprising said member, each in accordance with the present invention, will now be described, by way of example, with reference to the accompanying drawings, in which.

Figure 2:
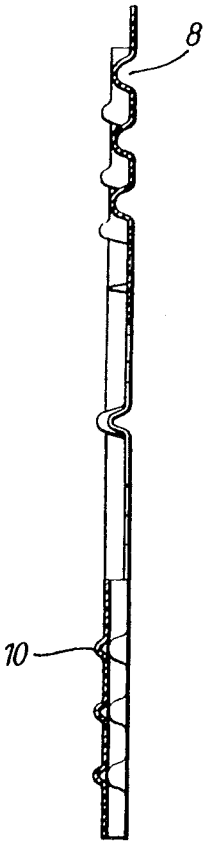
FIG. 2 shows a section along the line A—A of FIG. 1.
Figure 1:
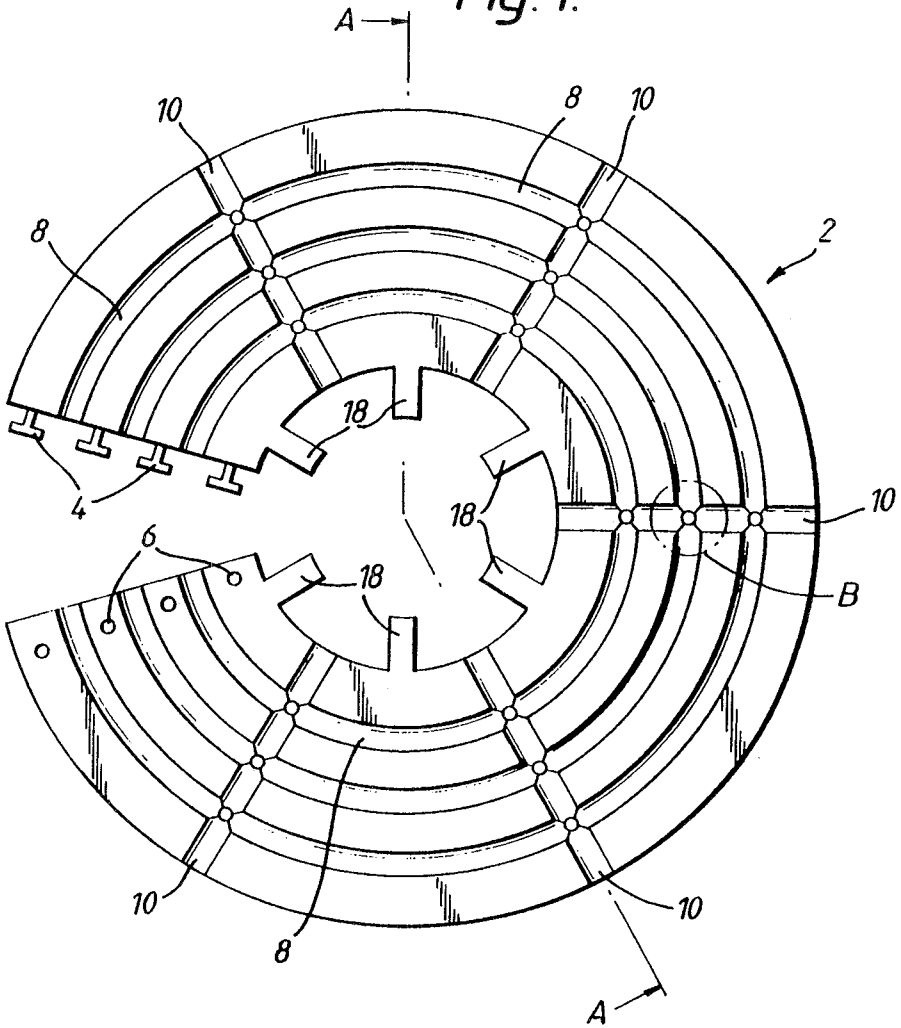
FIG. 1 shows a plan view of the planar member from above.

Referring to the drawings, a generally planar member 2, known as a vandal shield, is of annular configuration and made by vacuum forming from a sheet of electrically insulating and substantially non-tracking polymeric material. The shield 2 does not form a complete annulus, and the missing segment is bridged by a closure arrangement comprising four T-shaped projections 4 along one free edge and four co-operating apertures 6 along the opposing edge. In moving from the open configuration shown to a closed configuration whereby the opposing edges are secured together by the closure arrangement 4, 6, the sheet from which the shield 2 is formed will be forced to adopt a slightly frustoconical configuration, still regarded for present purposes however as being generally planar.

Figure 3:
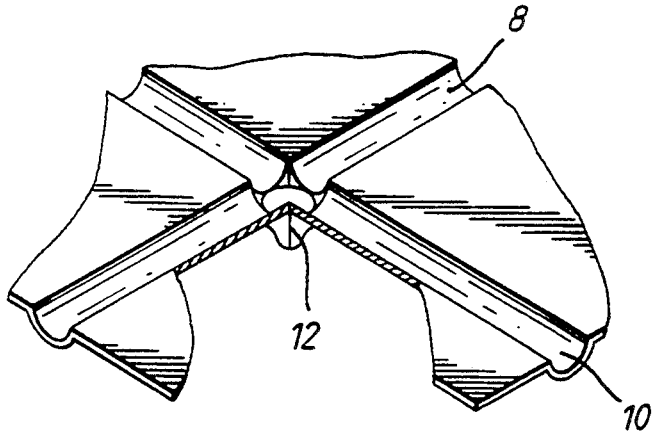
FIG. 3 is an isometric view of a detail of the planar member of FIG. 1 at the intersection B (FIG. 1) of two channels thereof.

During the forming process, two sets of generally U-shaped channels are formed in the upper surface of the sheet from which the shield 2 is formed. A first set of channels comprises three spaced-apart channels 8 that extend circumferentially around the shield 2. A second set of channels comprises five channels 10 that extend radially of the shield 2. Where each channel 8 and 10 intersects the other (FIG. 3), the forming platen is arranged to provide a deepening of the channelling such that a conical point projection 12 extends from the lower surface of the shield 2.

Figure 4:
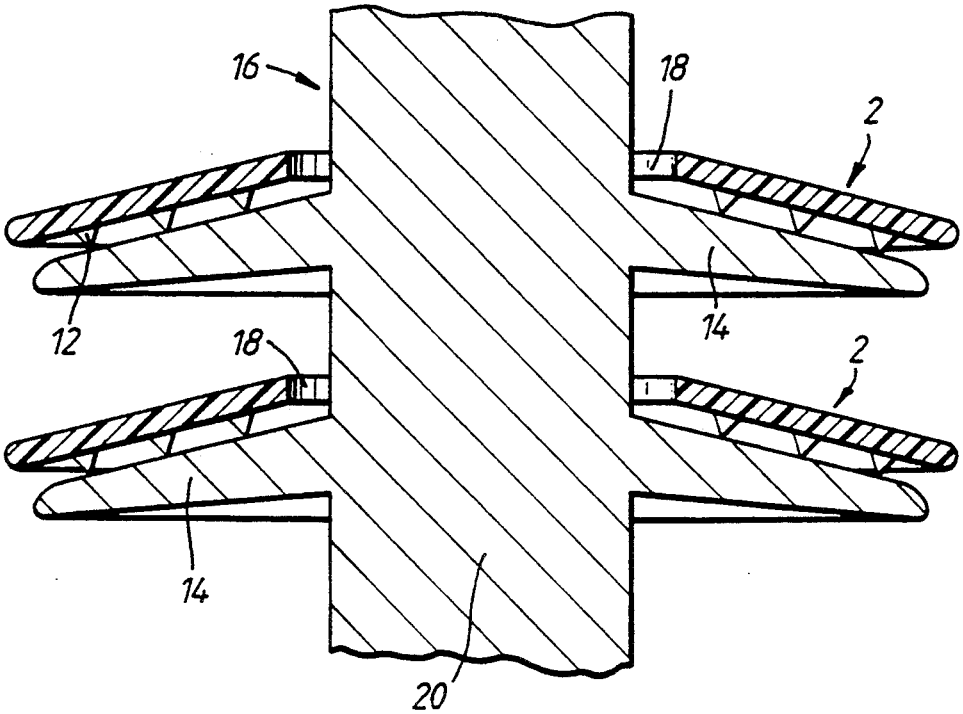
FIG. 4 shows diagrammatically a section through part of a porcelain shedded insulator with two of the members of FIG. 1 thereon.

In this way, the shield 2, whilst being generally planar, has a surface that undulates in two mutually-perpendicular directions, and has a plurality (fifteen) of projections 12 by which in operation it makes contact with the sheds 14 of a porcelain insulator 16 (FIG. 4). Six extensions 18 project inwardly from the inner rim of the shield 2 and serve to space the rim away from the core 20 of the insulator 16. As shown in FIG. 4, the annular width of the shield is selected such that it extends beyond the radial rim of the porcelain insulator shed 14 when mounted thereon. Thus, the major surface area of the shield 2 is spaced from the surface of the porcelain insulator 16, whilst the major surface area of the insulator shed 14 is covered and thus mechanically protected by the shield 2.

I claim:

1. An electrically insulating and substantially non-tracking generally planar member suitable for mounting on a shedded elongate porcelain high-voltage insulator, the member being of annular configuration and being arranged for mounting aruond and spaced apart from a core of the insulator and for mounting over and spaced apart from a shed of the insulator, wherein an upper surface of the member has channels formed therein, each of said channels having an upper channel surface and a lower channel surface, said lower channel surface extending downwardly from a lower surface of the planar member, a plurality of projections extending downwardly from said lower surface being provided by the intersection of said channels, said projections, in use, contacting the porcelain shed of the insulator.

2. A planar member according to claim 1, wherein the channels are provided by at least one channel extending generally circumferentially of the annular member and at least one channel extending generally radially thereof.

3. A planar member according to claim 1 in which the intersections of the channels are deeper than the other portions of the channels, such that the projections extend substantially in only one direction.

4. A planar member according to claim 1, having a plurality of inwardly directed extensions at its inner peripheral surface whereby in operation the member is spaced radially from the core of the insulator.

5. A planar member according to claim 1, wherein the channels provide indulations in the surface of the member that extend in two directions, preferably perpendicular to each other.

6. A planar member according to claim 1, the member being of wraparound configuration and having means to close the annular member together along adjacent edges around the insulator.

7. A planar member according to claim 6, wherein the closure means comprises at least one projection extending from one edge and at least one aperture at the other edge, whereby the projection and aperture are interengageable so as to secure the planar member to the insulator.

8. A planar member according to claim 1, made from polymeric material.

9. A planar member according to claim 1, wherein the planar member is a vacuum formed planar member.

10. A porcelain insulator that comprises an elongate core and at least one shed extending radially therefrom, wherein a planar member in accordance with claim 1 is mounted on said at least one shed.

11. An insulator according to claim 10, wherein the insulator comprises a plurality of said sheds and wherein one of the planar members is mounted on each of the sheds.

12. A planar member according to claim 2, wherein the channels are provided by at least two channels extending generally radially thereof.

* * * * *